US007909593B2

(12) United States Patent
Ronk et al.

(10) Patent No.: US 7,909,593 B2
(45) **Date of Patent: *Mar. 22, 2011**

(54) POWER TRANSFER DEVICE WITH TORQUE LIMITED PUMP

(75) Inventors: Aaron Ronk, Liverpool, NY (US); Randolph C. Williams, Weedsport, NY (US)

(73) Assignee: MAGNA Powertrain USA, Inc., Troy, MI (US)

( * ) Notice: Subject to any disclaimer, the term of this patent is extended or adjusted under 35 U.S.C. 154(b) by 199 days.

This patent is subject to a terminal disclaimer.

(21) Appl. No.: 12/263,780

(22) Filed: Nov. 3, 2008

(65) Prior Publication Data

US 2009/0050433 A1 Feb. 26, 2009

Related U.S. Application Data

(63) Continuation of application No. 11/388,067, filed on Mar. 23, 2006, now Pat. No. 7,445,438.

(60) Provisional application No. 60/668,455, filed on Apr. 5, 2005.

(51) Int. Cl.
*F03C 2/00* (2006.01)
*F04C 2/00* (2006.01)

(52) U.S. Cl. ..... 418/171; 418/182; 192/104 C; 192/104 F

(58) Field of Classification Search ..... 418/61.3, 418/166, 171, 182, 19–21, 102, 131–133; 192/104 C, 104 F; 417/313
See application file for complete search history.

(56) References Cited

U.S. PATENT DOCUMENTS

| | | | | |
|---|---|---|---|---|
| 2,758,689 | A | 8/1956 | Space | |
| 2,913,085 | A | 11/1959 | Spase | |
| 3,107,765 | A | 10/1963 | Davies | |
| 6,017,202 | A | 1/2000 | Durmack et al. | |
| 6,443,277 | B1 | 9/2002 | Taylor et al. | |
| 7,445,438 | B2 * | 11/2008 | Ronk et al. | 418/171 |
| 2006/0088432 | A1 * | 4/2006 | Ronk | 418/171 |

FOREIGN PATENT DOCUMENTS

WO WO2004/101973 11/2004

* cited by examiner

*Primary Examiner* — Theresa Trieu
(74) *Attorney, Agent, or Firm* — Harness, Dickey & Pierce, P.L.C.

(57) ABSTRACT

A lube pump is provided for supplying lubricant to various components of a power transmission unit of the type used in motor vehicles. The lube pump includes a pump assembly and a coupling mechanism for releaseably coupling the pump assembly to a driven shaft. The coupling is operable to release the pump assembly when the rotary speed of the shaft exceeds a threshold value.

30 Claims, 9 Drawing Sheets

POWER TRANSFER DEVICE WITH TORQUE LIMITED PUMP

CROSS REFERENCE

This application is a continuation of U.S. patent application Ser. No. 11/388,067 filed Mar. 23, 2006, which claims the benefit of U.S. Provisional Application Ser. No. 60/668,455 filed Apr. 5, 2005. The disclosures of the above applications are incorporated herein by reference.

FIELD OF THE INVENTION

The present invention relates generally to fluid pumps and, more particularly, to a torque limited fluid pump for use in power transmission units of the type installed in motor vehicles.

BACKGROUND OF THE INVENTION

As is well known, fluid pumps are used in power transmission units of the type installed in motor vehicles for supplying lubricant to the rotary drive components. Such power transmission units typically include manual and automatic transmissions and transaxles, four-wheel drive transfer cases and all-wheel drive power transfer assemblies. In many applications, the lube pump is a gerotor pump having an eccentric outer rotor and an inner rotor that is fixed for rotation with a drive member such as, for example, a drive shaft. The inner rotor has external lobes which are meshed with and eccentrically offset from internal lobes formed on the outer rotor. The rotors are rotatably disposed in a pressure chamber formed in a pump housing that is non-rotationally fixed within the power transmission unit. Rotation of the drive shaft results in the rotors generating a pumping action such that fluid is drawn from a sump in the power transmission unit into a low pressure inlet side of the pressure chamber and is subsequently discharged from a high pressure outlet side of the pressure chamber at an increased fluid pressure. The higher pressure fluid is delivered from the pump outlet through one or more fluid flow passages to specific locations along the driven shaft to lubricate rotary components and/or cool frictional components. One example of a bi-directional gerotor-type lube pump is disclosed in commonly-owned U.S. Pat. No. 6,017,202.

While gerotor pumps have widespread application in lubrication systems, several drawbacks result in undesirable compromises in their function and structure. For example, most conventional gerotor pumps are extremely inefficient, and are typically incapable of providing adequate lubricant flow at low rotary speeds while providing too much lubricant flow at high rotary speeds. To remedy such functional drawbacks, it is known to replace the conventional gerotor pump with a more expensive variable displacement lube pump or an electrically-controlled lube pump. Thus, a continuing need exists to develop alternatives to conventional gerotor lube pumps for use in power transmission units.

SUMMARY OF THE INVENTION

It is therefore an object of the present invention to provide a rotary-driven fluid pump having a torque-limiting mechanism.

As a further object of the present invention, the fluid pump includes a pump member driven by a shaft for generating a pumping action within a pressure chamber and a torque-limiting coupling that is operably disposed between the pump member and the shaft.

As a related object of the present invention, the rotary-driven fluid pump is a gerotor pump having inner and outer rotors while the torque-limiting coupling is operably disposed between the drive shaft and the inner rotor.

BRIEF DESCRIPTION OF THE DRAWINGS

Further objects, features and advantages associated with the present invention will be readily apparent from the following detailed specification and the appended claims which, in conjunction with the drawings, set forth the best mode now contemplated for carrying out the invention. Referring to the drawings:

DETAILED DESCRIPTION OF THE PREFERRED EMBODIMENTS

Figure 1:
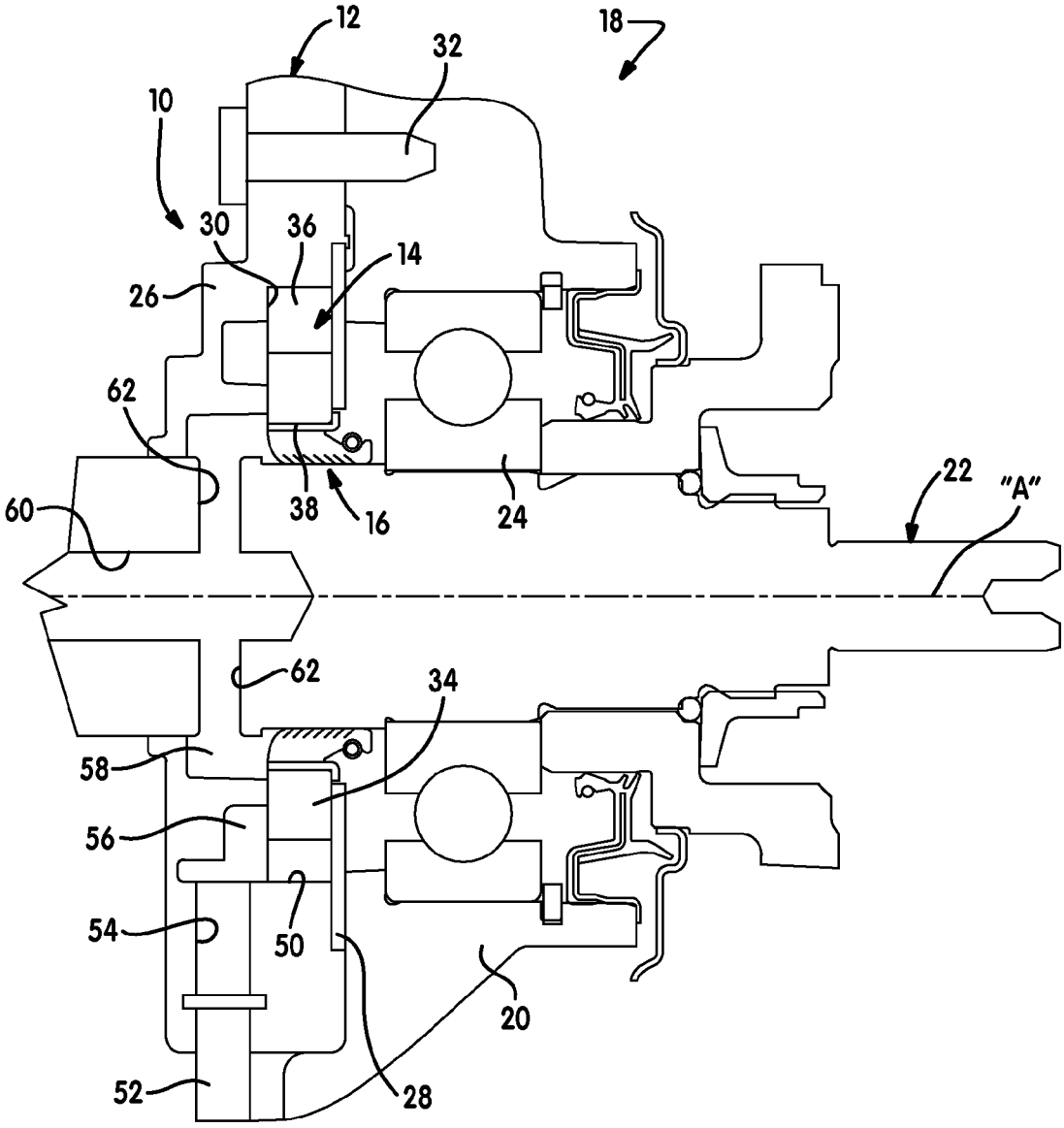
FIG. 1 is a partial sectional view of a fluid pump constructed according to the present invention and installed in an exemplary power transmission unit.
Figure 2:
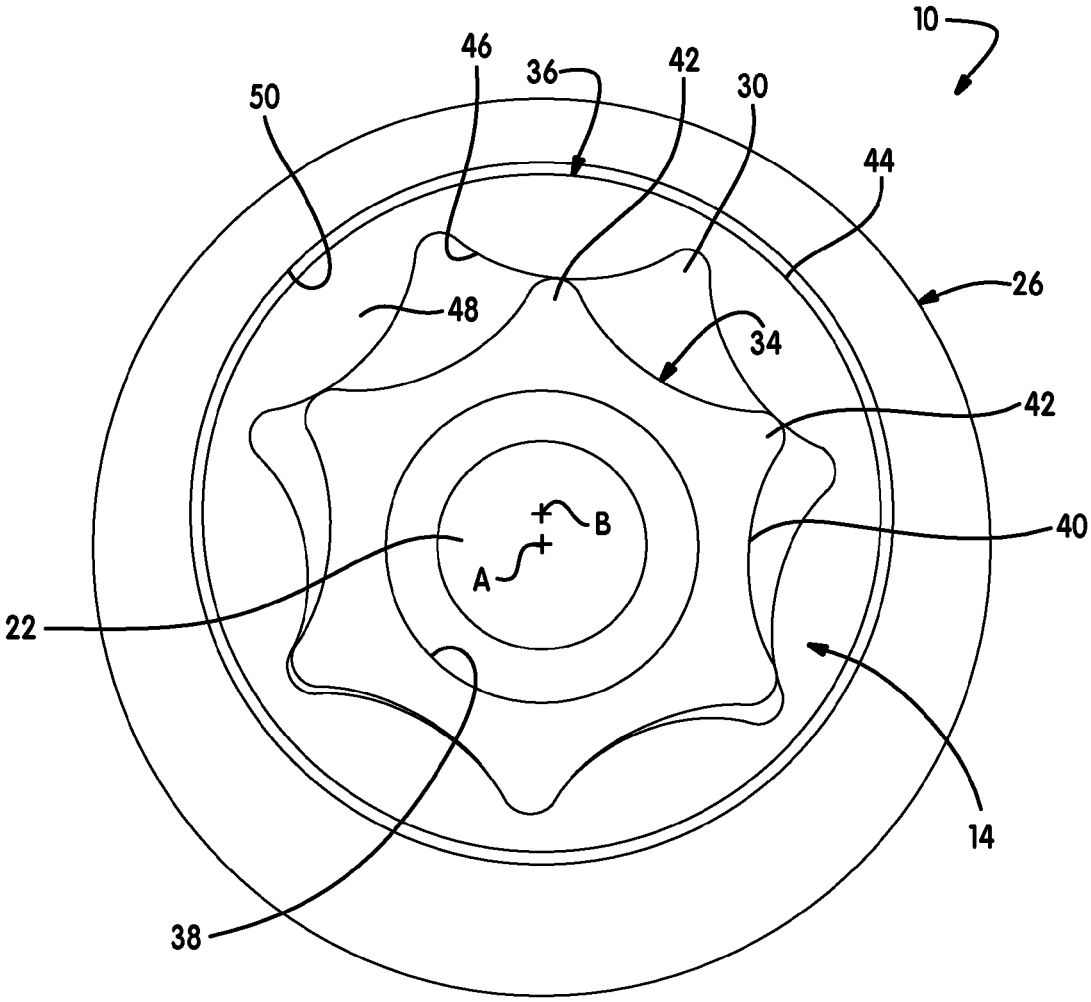
FIG. 2 is an end view of the fluid pump.

Referring primarily to FIGS. 1 and 2, the components of a torque-limited mechanically-driven fluid pump, hereafter referred to as gerotor pump 10, are shown. In general, gerotor pump 10 is contemplated for use in virtually any pump application requiring a supply of fluid to be delivered from a sump to a remote location for the purpose of lubricating and/or cooling rotary components. In general, gerotor pump 10 includes a pump housing assembly 12, a gerotor assembly 14 and a torque-limiting mechanism 16. In the embodiment shown, gerotor pump 10 is installed within a power transmission unit 18 having a casing 20 and a shaft 22 that is supported in casing 20 via a bearing assembly 24 for rotation about a first rotary axis "A". Pump housing assembly 12 is shown to include a pump housing 26 and a cover plate 28 which together define a circular pump chamber 30 within which gerotor assembly 14 is operably disposed. The origin of circular pump chamber 30 is offset from rotary axis "A" of shaft 22, as shown by construction line "B" in FIG. 2. Pump housing 26 is non-rotatably fixed to casing 20 such as, for example, via a plurality of bolts 32 only one of which is shown.

Gerotor assembly 14 includes an inner rotor (hereinafter referred to as pump ring 34) and an outer rotor (hereinafter referred to as stator ring 36) that are rotatably disposed in pump chamber 30. Pump ring 34 has a circular aperture defining an inner wall surface 38 that is coaxially disposed relative to shaft 22 for rotation about rotary axis "A" and a contoured outer peripheral wall surface 40 which defines a series of external lobes 42. Likewise, stator ring 36 includes a circular outer wall surface 44 and an inner peripheral wall surface 46 which defines a series of internal lobes 48. As seen, outer wall surface 44 of stator ring 36 is in sliding engagement with an inner wall surface 50 of pump chamber 30. In the embodiment shown, pump ring 34 has six external lobes 42 while stator ring 36 has seven internal lobes 48. Alternative numbers of external lobes 42 and internal lobes 48 can be employed to vary the pumping capacity of pump 10 as long as the number of internal lobes 48 is one greater than the number of external lobes 42.

Pump ring 34 is shown in FIG. 2 with its lobes 42 of outer peripheral surface 40 engaged with various points along inner peripheral wall surface 46 of stator ring 36 to define a series of pressure chambers there between. Upon rotation of pump ring 34 about rotary axis "A", stator ring 36 is caused to rotate in pump chamber 30 about axis "B" at a reduced speed relative to the rotary speed of pump ring 34. Such relative and eccentric rotation causes a progressive reduction in the volume of the pressure chambers, thereby generating a pumping action such that fluid is drawn from the sump through an inlet tube 52. As best seen from FIG. 1, Inlet tube 52 communicates with an inlet port 54 formed in pump housing 26 which, in turn, supplies fluid to an inlet chamber 56 that communicates with pump chamber 30. The pumping action caused by rotation between pump ring 34 and stator ring 36 within pump chamber 30 causes the fluid to ultimately be discharged into an annular outlet chamber 58 formed in pump housing 26 at the higher outlet pressure. Fluid discharged from outlet chamber 58 is delivered to a central lubrication passage 60 formed in shaft 22 via a plurality of radial supply bores 62. Central passage 60 communicates with various rotary elements located downstream of fluid pump 10 such as, for example, bearings, journal sleeves, speed gears and friction clutch packs via a series of radial lubrication and cooling delivery bores (not shown) also formed in shaft 22.

Figure 3:
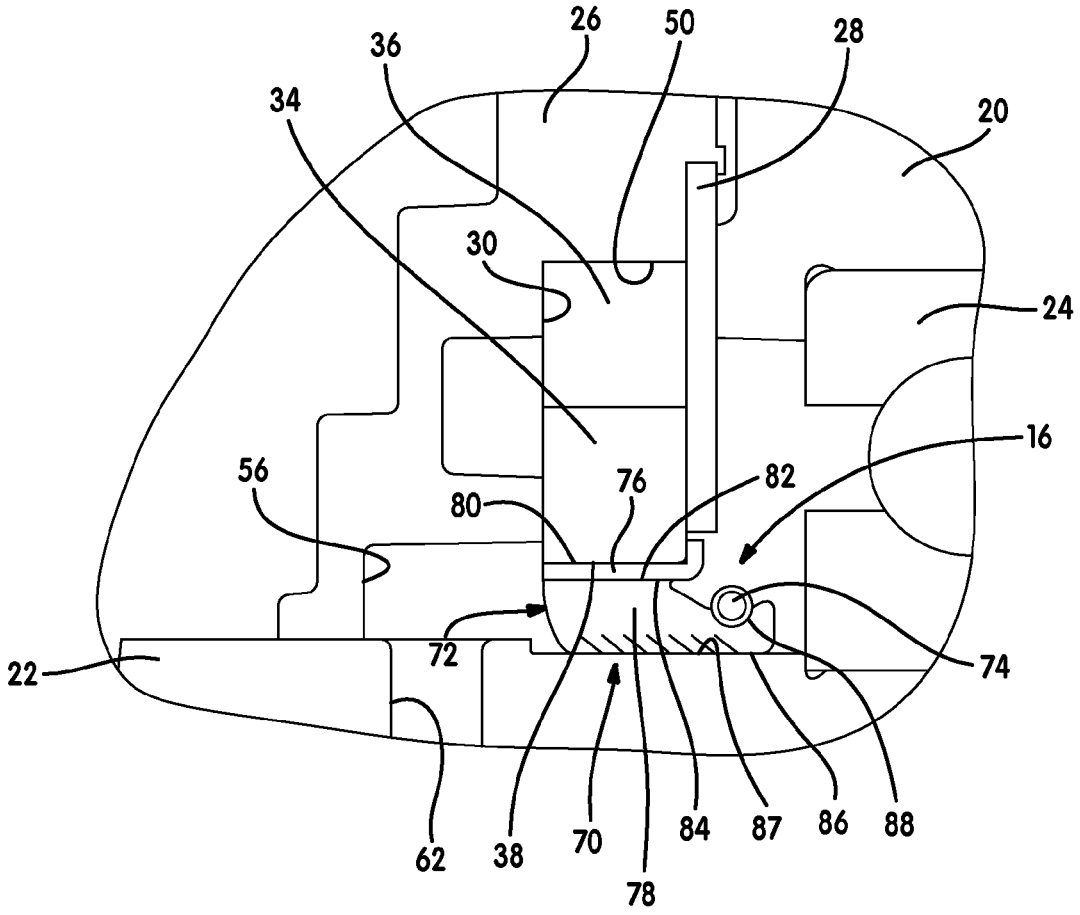
FIG. 3 is an enlarged partial view taken from FIG. 1 illustrating a torque-limiting coupling in greater detail.

Referring primarily to FIG. 3, torque-limiting coupling mechanism 16 is shown to include a drag ring assembly 70 that is operable for releaseably coupling pump ring 34 for rotation with shaft 22 using a friction interface there between. Drag ring assembly 70 includes a drag ring 72 and a drag seal 74. Drag ring 72 includes a flanged tubular sleeve 76 and an annular friction coupling ring 78. Preferably, sleeve 76 is made from a rigid material and has an outer surface 80 permanently secured within aperture 38 for common rotation with pump ring 34. Likewise, coupling ring 78 is preferably made of a resilient material and has its outer circumferential edge surface 82 permanently secured to an inner cylindrical surface 84 of sleeve 76. An inner circumferential edge surface 86 of coupling ring 78 is frictionally retained on outer wall surface 87 of shaft 22. The frictional interface between coupling ring 78 and shaft 22 is operable to cause pump ring 34 to rotate with shaft 22 without slip there between until the rotational speed of shaft 22 exceeds a threshold value. Once this rotary speed threshold value is exceeded, the torque required to drive pump 10 will exceed the torque limit of coupling ring 78 and cause it to slip, thereby causing relative rotation between shaft 22 and pump ring 34. Drag seal 74 surrounds coupling ring 78 and is sized to provide a desired compressive clamping force on shaft 22 that will be overcome upon shaft 22 exceeding the threshold rotary speed. Preferably, drag seal 74 is retained in a groove 88 formed in coupling ring 78.

Figure 4:
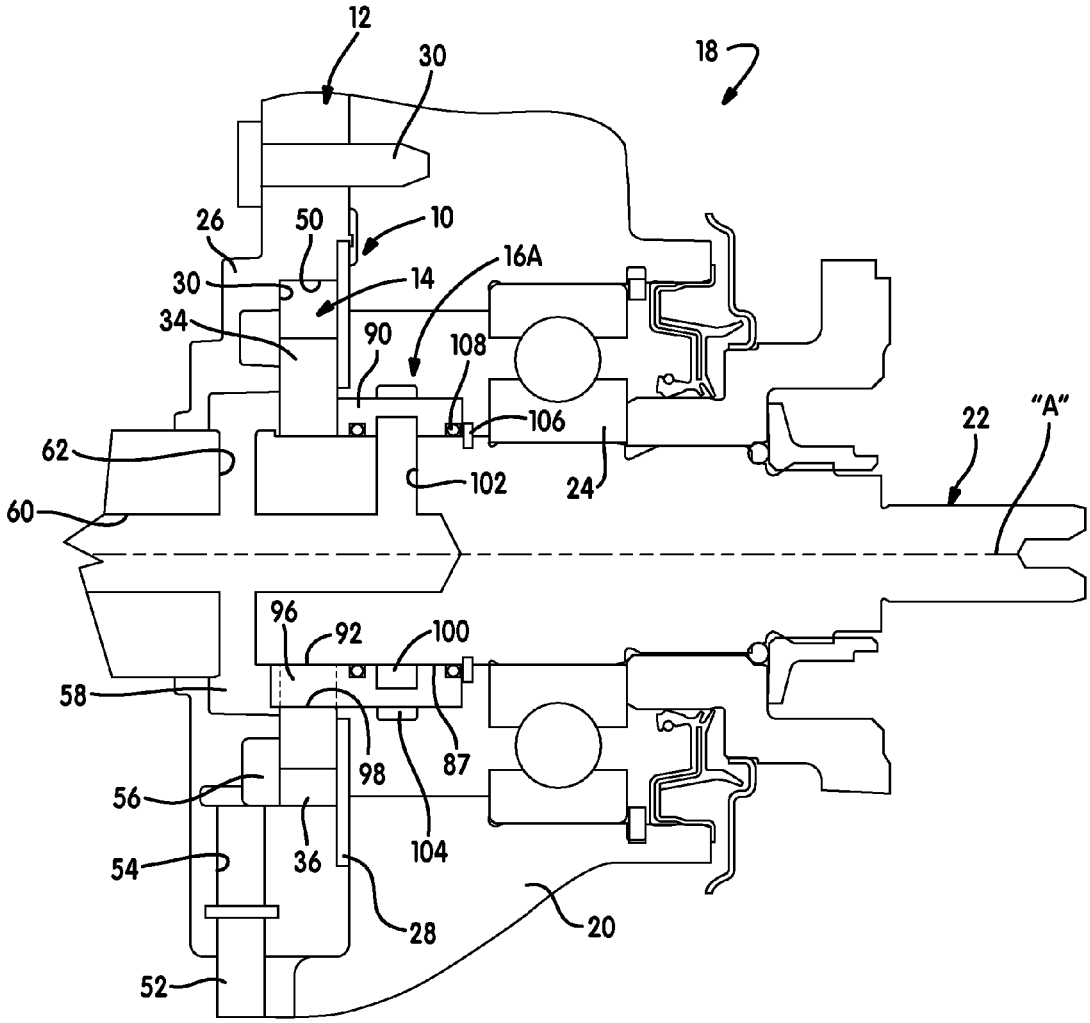
FIG. 4 is a partial sectional view of the fluid pump constructed according to an alternative embodiment of the present invention.
Figure 5A:
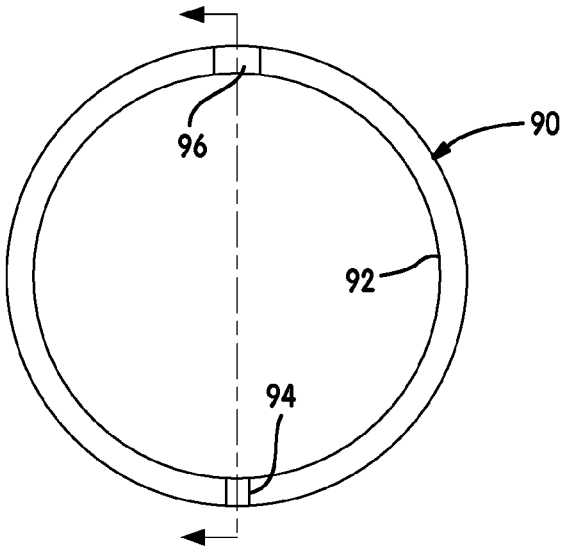
FIGS. 5A and 5B are end and side views of a torque-limiting coupling associated with the fluid pump shown in FIG. 4.
Figure 5B:
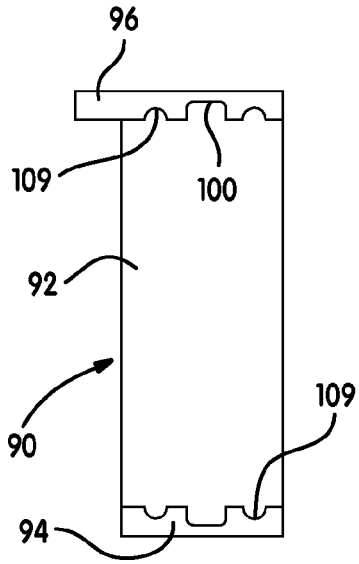

Referring now to FIGS. 4, 5A and 5B, pump 10 is shown with a different torque-limiting coupling mechanism 16A that is arranged to releaseably couple pump ring 34 of gerotor assembly 14 to shaft 22. In particular, torque-limiting coupling 16A includes a coupling ring 90 having a circular aperture with an inner wall surface 92 fitted on shaft 22 and which is split by a through slot 94. A lug 96 extends from coupling ring 90 and is nested with a keyway slot 98 formed in pump ring 34. As seen, coupling ring 90 further includes an oil channel 100 that is in fluid communication with central passage 60 via one or more radial supply bores 102. Preferably, the frictional engagement of coupling ring 90 with shaft 22 will be controlled by the interference fit between inner surface 92 of coupling ring 90 and outer surface 87 of shaft 22. This frictional interface may be designed to provide different slip conditions based on: the type of material used for split coupling ring 90; the optional use of frictional materials on inner wall surface 92 of coupling ring 90; and the use of retaining members (i.e., clamps, springs, seals, etc.). For example, by adjusting the size, weight, and weight distribution of coupling ring 90, the number of retaining members, and/or the size of oil channel 100, any desired level of shaft torque (based on its rotary speed) can be selected to initiate slip between coupling ring 90 and shaft 22. As seen, a retainer ring 104 surrounds and exerts a compressive load on coupling ring 90 for providing frictional engagement with shaft 22. A stop ring 106 limits axial movement of coupling ring 90 relative to pump ring 34 while a pair of O-ring seals 108 are seated in grooves 109 formed in coupling ring 90 to provide a fluid-tight seal between coupling ring 90 and shaft 22 on opposite sides of oil channel 100.

Figure 5C:
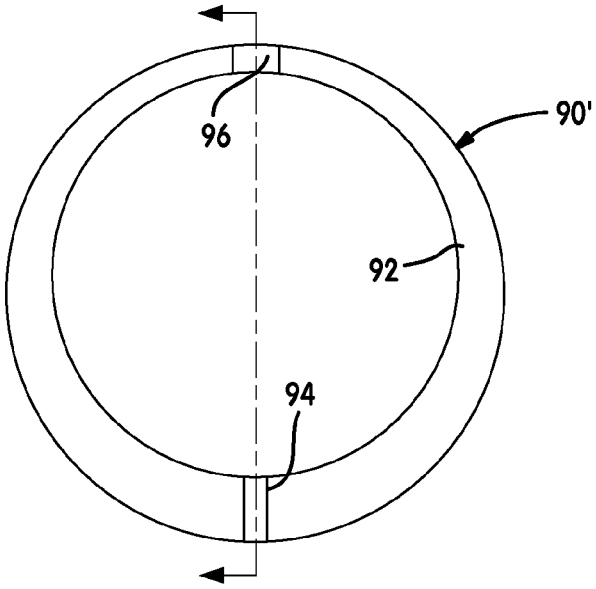
FIGS. 5C and 5D are end and side views of an alternative construction for the torque-limiting coupling shown in FIGS. 5A and 5B.
Figure 5D:
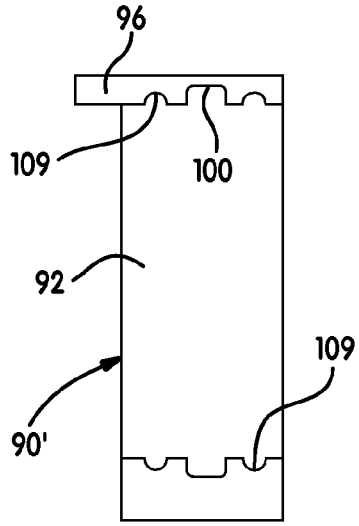

In operation, fluid discharged from pump 10 due to rotation of shaft 22 is delivered to oil channel 100 via central passage 60 and supply ports 102. Since most lubrication systems use fixed orifice delivery bores, an increase in the fluid pressure is generated in passage 60 as the flow rate through pump 10 increases. The flow rate is governed by the rotary speed of shaft 22 which, therefore, causes the fluid pressure to increase. This increased fluid pressure is delivered to oil channel 100 which then acts to cause radial expansion of coupling ring 90 due to slot 94. As noted, seals 108 are provided to maintain fluid pressure within oil channel 100. Once the threshold rotary speed value is reached by shaft 22, the centrifugal forces and fluid pressure in channel 100 cause coupling ring 90 and pump ring 34 to slip relative to shaft 22, thereby limiting the maximum fluid pressure that can be generated by pump 10. FIGS. 5C and 5D are generally similar to FIGS. 5A and 5B except that a coupling ring 90' is shown to have an eccentric outer configuration to provide and additional centrifugal effect to its clamping characteristics.

Figure 6:
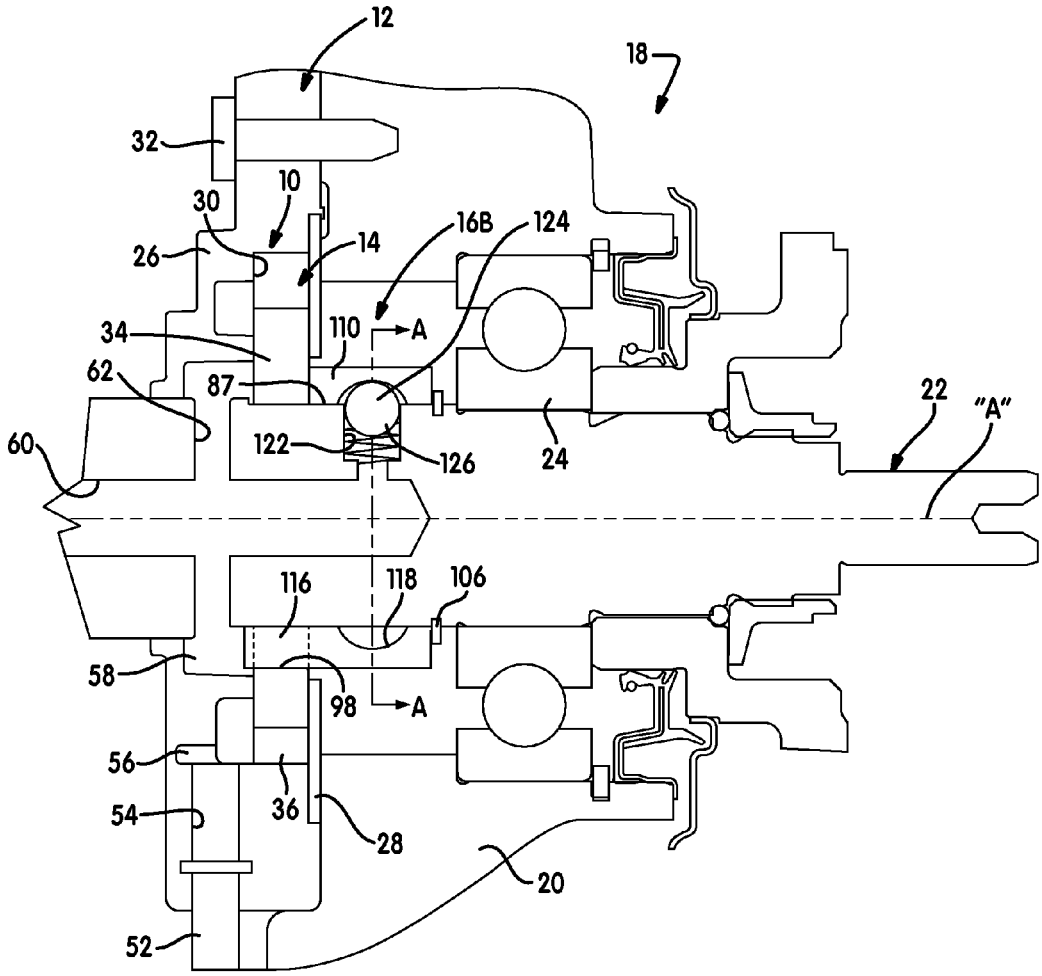
FIG. 6 is a partial sectional view of a fluid pump of the present invention constructed according to another alternative embodiment.
Figure 7:
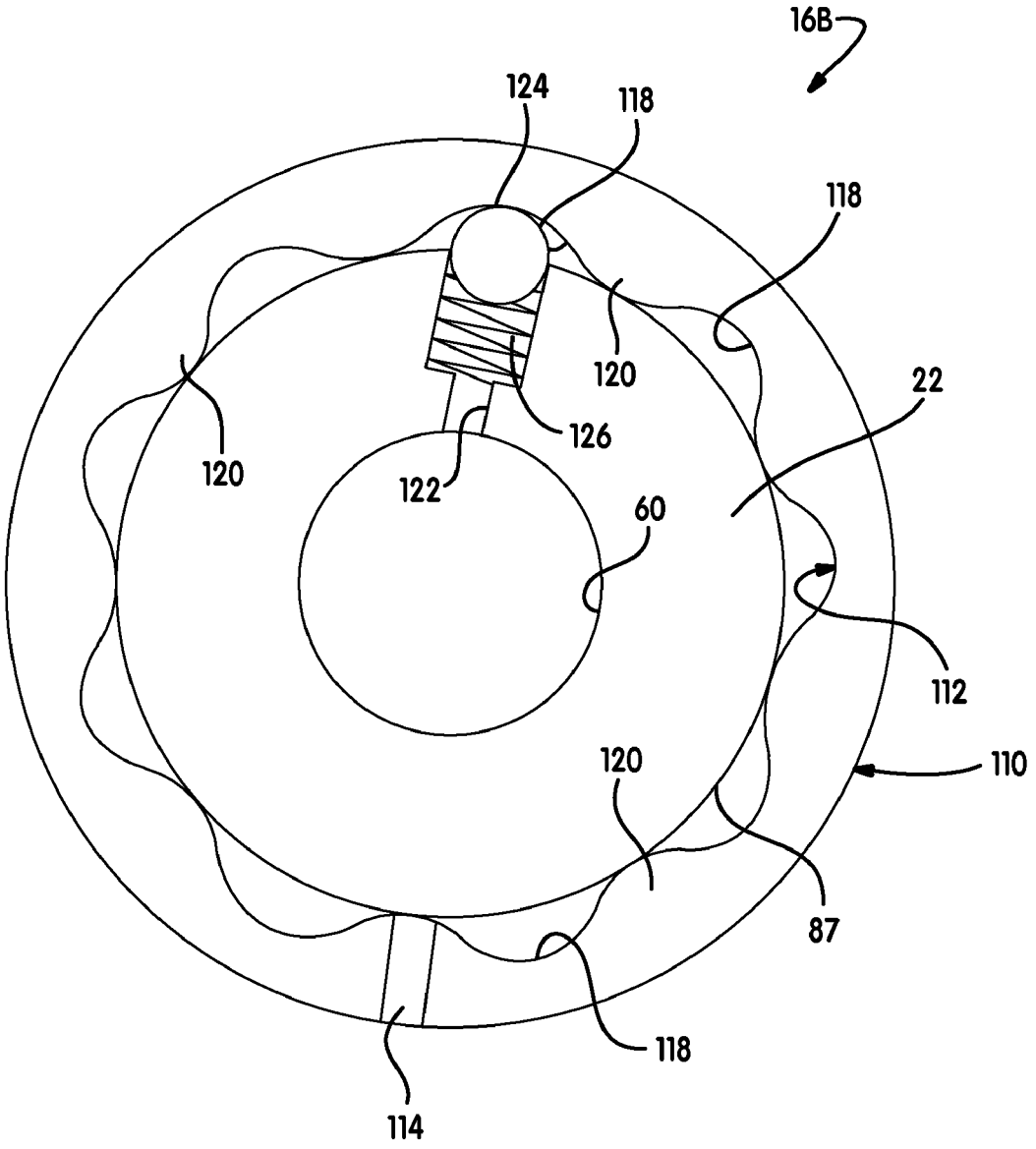
FIG. 7 is a sectional view taken along line A-A shown in FIG. 6.

FIG. 6 illustrates pump 10 equipped with yet another torque-limiting coupling mechanism 16B arranged for releaseably coupling pump ring 34 to shaft 22. In particular, torque-limiting coupling 16B includes a coupling ring 110 having a sinsusoidal aperture 112 encircling shaft 22 and which is split via a through slot 114. A lug 116 extends from coupling ring 110 and is nested in keyway slot 98 formed in pump ring 34. As best seen from FIG. 7, the sinsusoidal configuration of coupling ring 110 defines a series of oil chambers 118 separated by radial lugs 120 that engage outer surface 87 of shaft 22. A radial supply bore 122 provides fluid communication between central passage 60 in shaft 22 and chambers 118 in coupling ring 110. A ball 124 is biased by a spring 126 into engagement with sinsusoidal aperture 112 within one of chambers 118. Ball 124 and spring 126 are retained in an enlarged portion of supply bore 122.

In operation, fluid discharged from pump 10 due to rotation of shaft 22 is delivered from central passage 60 to chamber 118 within which ball 124 is disposed via supply bore 122. As the fluid pressure in passage 60 increases with increased rotary speed of shaft 22, the biasing force exerted by spring 126 on ball 124 is augmented by the fluid pressure in bore 122, thereby causing radial expansion of coupling ring 110. Once the threshold rotary speed value is reached by shaft 22, the frictional interface between lugs 120 and shaft surface 87 is overcome so as to permit shaft 22 to rotate relative to coupling ring 110 and pump ring 34, thereby limiting the maximum fluid pressure generated by pump 10. Ball 124 rotates with shaft 22 and moves into and out of retention with sequential chambers 118 until the speed of shaft 22 is reduced to permit ball 124 to retracted so as to re-establish frictional engagement of coupling ring 110 with shaft 22.

Figure 8:
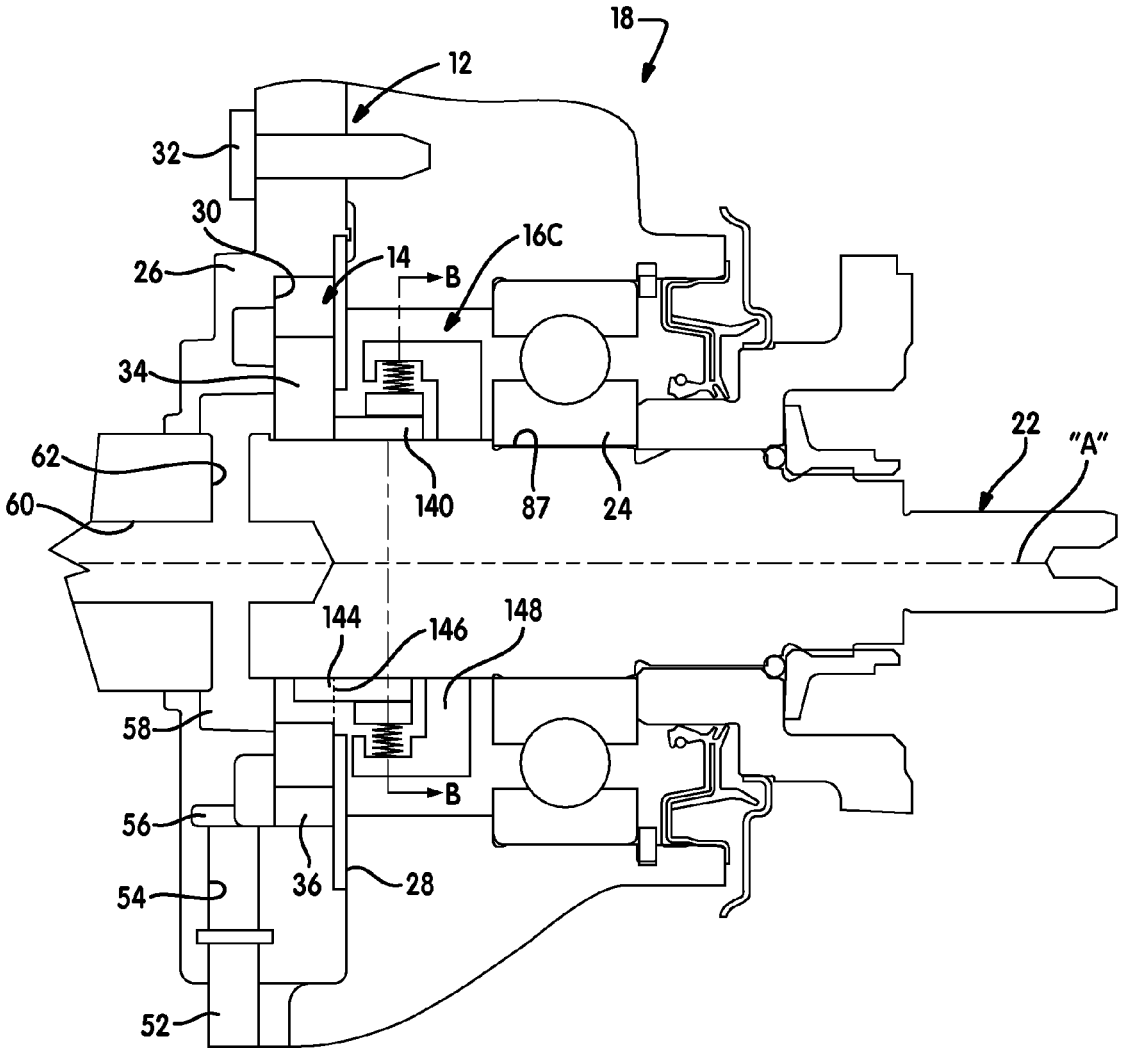
FIG. 8 is a partial sectional view of a fluid pump constructed according to a further alternative embodiment of the present invention.
Figure 9:
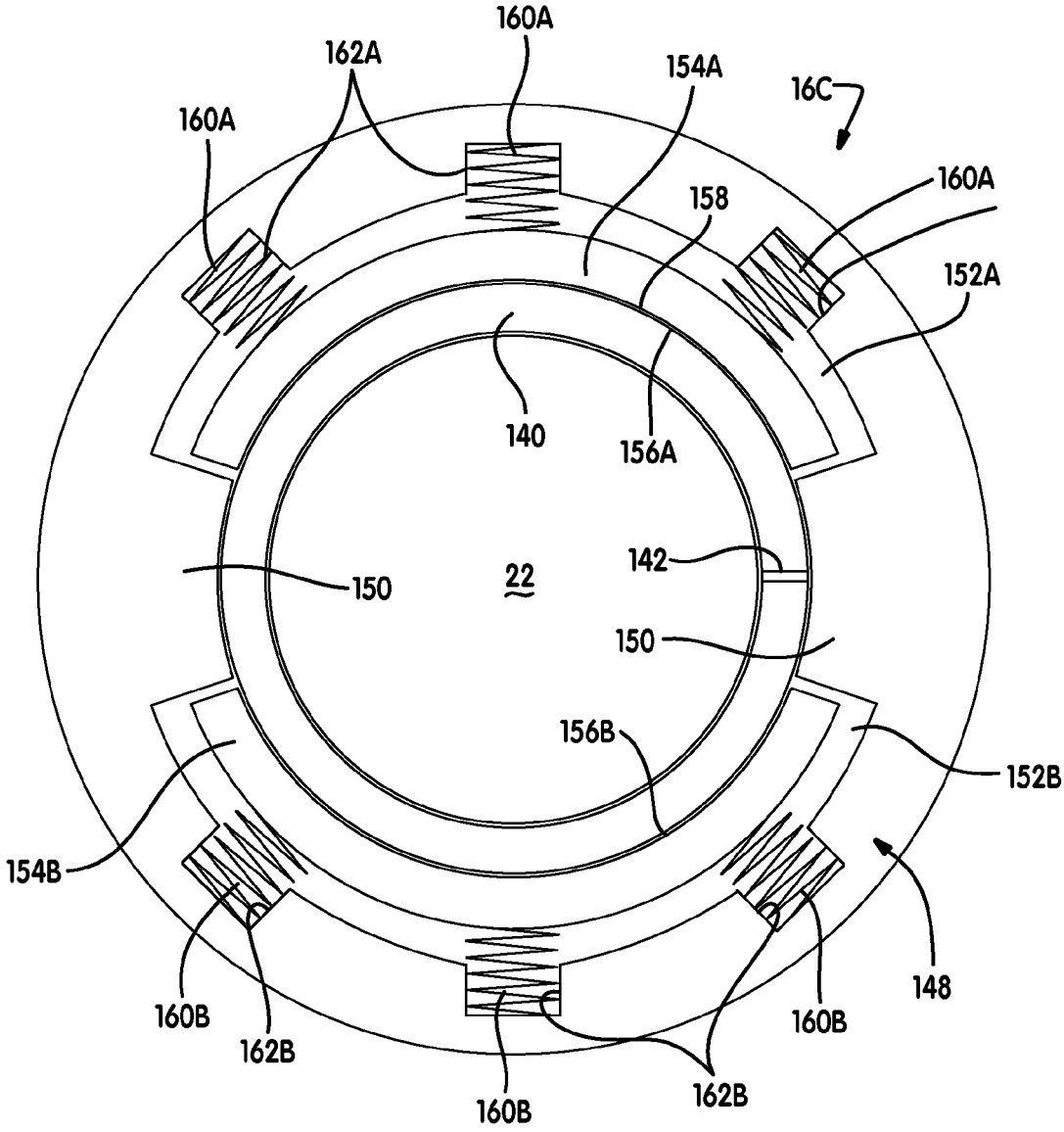
FIG. 9 is a partial sectional view taken along line B-B of FIG. 8.

Referring now to FIGS. 8 and 9, another embodiment of a torque-limiting coupling mechanism 16C is shown installed within power transmission unit 18 in association with fluid pump 10 for releaseably coupling pump ring 34 to shaft 22. Torque-limiting coupling 16C includes a friction sleeve 140 encircling shaft 22 and having a through slot 142 to define a split sleeve configuration. Sleeve 140 further includes one or more lugs 144 that are nested in corresponding keyways 146 formed in pump ring 34. Torque-limiting coupling 16C further includes a drive casing 148 that is fixed for rotation with shaft 22 and has a pair of radially-inwardly extending spacer lugs 150. Lugs 150 are arranged to define a pair of force chambers 152A and 152B in conjunction with sleeve 140. As seen, a pair of arcuate friction shoes 154A and 154B are retained in corresponding force chambers 152A and 152B. Friction shoe 154A has an inner wall surface 156A adapted to be biased into frictional engagement with an outer wall surface 158 of sleeve 140 via a first plurality of biasing springs 160A. Springs 160A are retained in retention cavities 162A formed in drive casing 148. Likewise, friction shoe 154B has an inner wall surface 156B adapted to be biased into frictional engagement with outer wall surface 158 of sleeve 140 via a second plurality of biasing springs 160B. Springs 160B are likewise retained in retention cavities 162B formed in casing 148.

In operation, springs 160A and 160B cause corresponding friction shoes 154A and 154B to apply a frictional engagement force on sleeve 140 for causing a clamping force to be applied by sleeve 140 on shaft 22. As such, sleeve 140 is releaseably coupled for rotation with shaft 22, thereby releaseably coupling pump ring 34 for rotation with shaft 22. This clamped engagement of sleeve 140 with shaft 22 is maintained until the rotary speed of shaft 22 exceeds a threshold value at which point the centrifugal forces acting on shoes 154A and 154B oppose and overcome the biasing force of springs 160A and 160B. As such, sleeve 140 and pump ring 34 begin to slip relative to shaft 22, thereby limiting the fluid pressure generated by pump 10.

Preferred embodiments have been disclosed to provide those skilled in the art an understanding of the best mode currently contemplated for the operation and construction of the present invention. The invention being thus described, it will be obvious that various modifications can be made without departing from the true spirit and scope of the invention, and all such modifications as would be considered by those skilled in the art are intended to be included within the scope of the following claims.

What is claimed is:

1. A power transmission unit comprising:

a shaft; and a torque-limited fluid pump having a pump housing, a pump assembly and a coupling mechanism, said pump housing defining an inlet passage, an outlet passage and a pump chamber communicating with said inlet and outlet passages, said pump assembly disposed in said pump chamber and including a pump member, and said coupling mechanism releaseably couples said pump member for rotation with said shaft and permits said pump member to rotate relative to said shaft when the rotary speed of said shaft exceeds a threshold speed value, said coupling member includes a non-resilient first annular member fixed to said pump member and a resilient second annular member engaging said first annular member and said shaft.

2. The power transmission unit of claim 1 wherein said first annular member is a tubular sleeve fixed to said pump member and said second annular member is a resilient ring fixed to said sleeve and frictionally engaging said shaft.

3. The power transmission unit of claim 1 wherein said coupling mechanism further includes a retention member for clamping said second annular member to said shaft.

4. The power transmission unit of claim 3 wherein said retention member is an annular component surrounding a portion of said resilient second annular member and exerting a compressive load thereon for frictionally coupling said resilient second annular member to said shaft.

5. The power transmission unit of claim 1 wherein said outlet passage provides pressurized fluid to a component of the power transmission unit.

6. The power transmission unit of claim 5 wherein said pressurized fluid is supplied to lubricate said component.

7. The power transmission unit of claim 5 wherein said pressurized fluid is supplied to control movement of said component.

8. A power transmission unit comprising:

a shaft; and a torque-limited fluid pump having a pump housing, a pump assembly and a coupling mechanism, said pump housing defining an inlet passage, an outlet passage and a pump chamber communicating with said inlet and outlet passages, said pump assembly disposed in said pump chamber and including a pump member, and said coupling mechanism releaseably couples said pump member for rotation with said shaft and permits said pump member to rotate relative to said shaft when the rotary speed of said shaft exceeds a threshold speed value, said coupling member includes a coupling ring fixed to said pump member and which surrounds said shaft for exerting a compressive force thereon for frictionally coupling said coupling ring for rotation with said shaft, and wherein said coupling ring defines a pressure chamber that is in fluid communication with said outlet chamber.

9. The power transmission unit of claim 8 wherein rotation of said shaft causes said coupling ring to drive said pump member so as to generate a pumping action for drawing low pressure fluid from a sump through said inlet passage and discharging high pressure fluid from said outlet passage, and wherein the fluid in said outlet passage communicates with said pressure chamber in said coupling ring such that the fluid pressure exerted on said coupling ring within said pressure chamber is a function of the rotary speed of said shaft.

10. The power transmission unit of claim 9 wherein the fluid pressure in said pressure chamber causes said coupling ring to slip relative to said shaft when the rotary speed of said shaft exceeds its threshold value.

11. The power transmission unit of claim 10 wherein said coupling ring has an eccentric configuration operable to decrease the frictional engagement of said coupling ring with said shaft in response to increasing rotary speed of said shaft.

12. The power transmission unit of claim 10 wherein said coupling mechanism further includes a retainer ring surrounding said coupling ring and applying said compressive force to said coupling ring.

13. The power transmission unit of claim 8 wherein said outlet passage communicates with a fluid supply passage in said shaft, and wherein said shaft further includes a supply bore communicating with said supply passage in said shaft and said pressure chamber in said coupling ring.

14. The power transmission unit of claim 13 wherein said coupling mechanism further includes a follower disposed in said supply bore and a biasing spring for biasing said follower into engagement with said coupling ring.

15. The power transmission unit of claim 14 wherein said coupling ring includes a sinusoidal inner surface defining a series of lugs engaging said shaft and cam chambers between adjacent lugs, and wherein said follower is biased by said spring into one of said cam chambers.

16. The power transmission unit of claim 14 wherein rotation of said shaft causes said coupling ring to drive said pump member so as to generate a pumping action for drawing low pressure fluid from a sump into said pump chamber through said inlet passage and discharging high pressure fluid from said outlet passage into said supply passage, said fluid pressure in said supply passage communicating with said supply bore such that said fluid pressure exerted on said follower is a function of the rotary speed of said shaft.

17. The power transmission unit of claim 8 wherein said outlet passage provides pressurized fluid to a component of the power transmission unit.

18. The power transmission unit of claim 17 wherein said pressurized fluid is supplied to lubricate said component.

19. The power transmission unit of claim 17 wherein said pressurized fluid is supplied to control movement of said component.

20. A power transmission unit comprising:

a shaft; and a fluid pump including a pump housing, a pump assembly and a coupling mechanism, said pump housing defines an inlet passage, an outlet passage and a pump chamber communicating with said inlet and outlet passages, said pump assembly is disposed in said pump chamber and includes a pump member, and said coupling mechanism releaseably couples said pump member for rotation with said shaft and permits said pump member to rotate relative to said shaft when the rotary speed of said shaft exceeds a threshold speed value, said coupling mechanism including a coupling ring encircling said shaft and which exerts a compressive force thereon so as to frictionally couple said coupling ring for rotation with said shaft, said coupling ring defining an annular pressure chamber that is in fluid communication with said outlet passage.

21. The power transmission unit of claim 20 wherein said coupling ring includes a lug retained in a keyway formed in said pump member such that said pump member rotates with said coupling ring.

22. The power transmission unit of claim 20 wherein rotation of said shaft causes said coupling ring to drive said pump member so as to generate a pumping action for drawing low pressure fluid from a sump into said pump chamber through said inlet passage and discharging high pressure fluid from said outlet passage, and wherein the fluid pressure in said outlet passage communicates with said pressure chamber in said coupling ring such that the fluid pressure exerted on said coupling ring within said pressure chamber is a function of the rotary speed of said shaft.

23. The power transmission unit of claim 22 wherein the fluid pressure in said pressure chamber causes said coupling ring to slip relative to said shaft when the rotary speed of said shaft exceeds its threshold value.

24. The power transmission unit of claim 20 wherein said coupling ring has an eccentric configuration that functions to decrease the frictional engagement of said coupling ring with said shaft in response to increasing the rotary speed of said shaft.

25. The power transmission unit of claim 20 wherein said coupling mechanism further includes a retainer ring surrounding said coupling ring and applying said compressive force to said coupling ring.

26. The power transmission unit of claim 20 wherein said coupling mechanism further includes a pair of axially spaced seals, each seal engaging said coupling ring and said shaft on opposite sides of said pressure chamber.

27. The power transmission unit of claim 20 wherein said coupling ring includes a split to allow radial expansion of said coupling ring in response to pressurized fluid being introduce to said pressure chamber.

28. The power transmission unit of claim 20 wherein said outlet passage provides pressurized fluid to a component of the power transmission unit.

29. The power transmission unit of claim 28 wherein said pressurized fluid is supplied to lubricate said component.

30. The power transmission unit of claim 28 wherein said pressurized fluid is supplied to control movement of said component.

* * * * *